US005163894A

United States Patent [19]

Ogawa

[11] Patent Number: 5,163,894

[45] Date of Patent: Nov. 17, 1992

[54] FEMALE DIE FOR PAPERBOARD STAMPER

[76] Inventor: Masaaki Ogawa, 4-6,4 chome, Rokucho, Adachi-ku, Tokyo, Japan

[21] Appl. No.: 707,806

[22] Filed: May 30, 1991

[51] Int. Cl.[5] ..... B31B 1/25

[52] U.S. Cl. ..... 493/468; 493/59; 493/396

[58] Field of Search ..... 493/396, 400, 59, 60, 493/61, 62, 401, 404, 468

[56] References Cited

U.S. PATENT DOCUMENTS 2,765,716 10/1956 Andersson .
2,996,961 8/1961 Polayes ..... 493/396
3,213,767 10/1965 Tomak ..... 493/396
3,526,566 9/1970 Gibson et al. .
3,884,132 5/1975 Snodgrass .
4,112,827 9/1978 Kang .
4,816,015 3/1989 Holder ..... 493/400

FOREIGN PATENT DOCUMENTS 86776 7/1950 Norway ..... 493/396

*Primary Examiner*—Bruce M. Kisliuk
*Assistant Examiner*—Jack W. Lavinder
*Attorney, Agent, or Firm*—Wenderoth, Lind & Ponack

[57] ABSTRACT

The invention concerns a female die for a paperboard stamper. A thin metal plate is removably mounted by adhesive tape on a counterplate of the paperboard stamper, and a female die member has a groove corresponding in shape to the shape of a male die of the paperboard stamper.

14 Claims, 5 Drawing Sheets

FEMALE DIE FOR PAPERBOARD STAMPER

BACKGROUND OF THE INVENTION

1. Field of the Invention

This invention relates to a female die in a paperboard stamper and, more particularly, to a female die in a paperboard stamper which can contribute to the simplification of preparations for stamping of paperboard.

2. Prior Art

A prior art paperboard stamper used for manufacturing paperboard products such as cartons uses a female die comprising a plate-like female die member, in which the entirety of one surface is formed with a groove corresponding in shape to the shape of a blade of a male die, and which is secured by adhesive to a counterplate which is found at the bottom of a stamping area (as disclosed in U.S. Pat. No. 4,256,026).

This female die, however, has the following problems. The groove in the female die member is formed by expensive machining. When the female die member is used for manufacturing a paperboard product, it is discarded after use, and this means waste of material. The operation of removing the female die member from the counterplate takes a long time due the presence of adhesive between these two parts. The female die cannot be readily stored for restamping.

Meanwhile, it has been the practice to fabricate a female die by forming a female die member with a groove corresponding in shape to the shape of a male die blade using a cutter knife. In this case, the formation of the groove with the cutter knife requires considerable skill.

SUMMARY OF THE INVENTION

The present invention seeks to overcome the drawbacks inherent in the prior art female dies for paperboard stampers, such as the difficulty of fabrication, waste of material and cumbersome operation of removing the female die member.

An object of the invention, accordingly, is to provide a female die for a paperboard stamper which can be used for a large number of stamping operations irrespective of the male die, which permits improvement of the operational efficiency and which can be stored conveniently.

According to the invention, there is provided a female die for a paperboard stamper which comprises a thin metal plate removably mounted by adhesive tape on a counterplate of the paperboard stamper and a female die member having a groove corresponding in shape to the shape of a male die of the paperboard stamper.

With the female die according to the invention, in which the metal plate with the female die member is mounted by adhesive tape on the counterplate, the metal plate can be mounted and dismounted at any time, thus simplifying the preparations for stamping and operations after stamping. In addition, since the metal plate is thin, it is possible to store a large number of metal plates in a narrow space. Further, for a re-stamping operation the metal plate need only be secured again to the counterplate using adhesive tape. Excellent economy is thus attainable.

DETAILED DESCRIPTION OF THE PREFERRED EMBODIMENT

Now, an embodiment of the invention will be described in detail.

Figure 1:
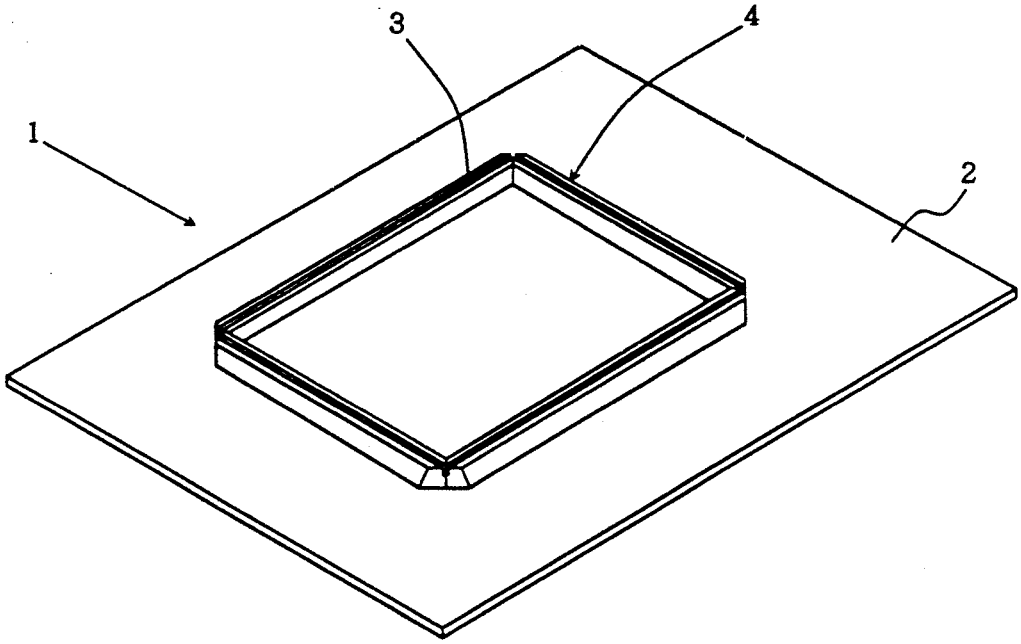
FIG. 1 is a perspective view showing an embodiment of the female die according to the invention.

FIG. 1 shows an embodiment of a female die 1 according to the invention. This female die comprises a metal plate 2 about 0.45 mm in thickness and made of a steel plate of a rectangular shape, for instance, and having a chemically treated surface. A female die member 4 has a groove 3 corresponding in shape to the shape (e.g., a quadrangle) a rule blade 6*a* of male die 6 of paperboard stamper 5 to be described later. The female die member 4 is provided on one surface of the metal plate 2.

A method of forming the female die 1 will now be described with reference to FIGS. 2 to 7.

Figure 2:
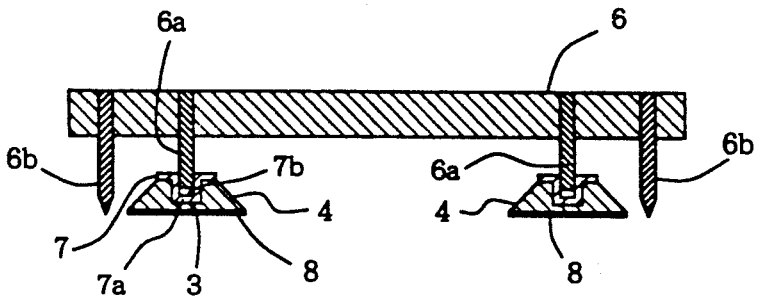
FIG. 2 is a sectional view showing a a female die member according to the invention on a male die.

As shown in FIG. 2, the female die member 4 with an intermediary member 7, is mounted on the rule blade 6*a* of the male die 6. Intermediary member 7 has a channel-like sectional profile with a projection 7*a* engageable in groove 3 and a recess 7*b* engageable on the rule blade 6*a*. The female die member 4 further has double-side adhesive tape 8 applied to its bottom. The male die 6 further has a cutter blade 6*b* provided outside the rule blade 6*a*.

Figure 3:
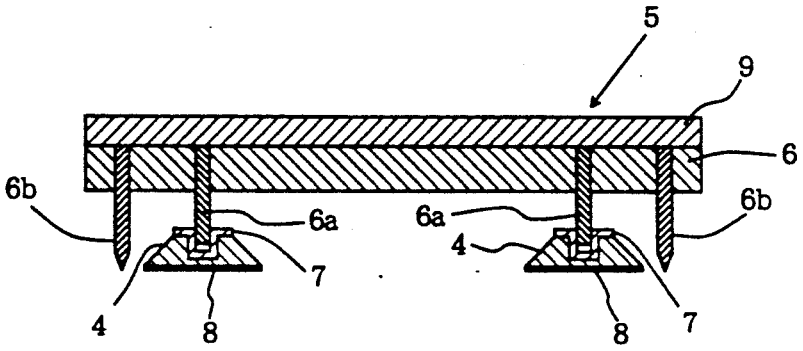
FIG. 3 is a sectional view showing a state in which a male die is mounted on a top base.

The top of the male die 6, in the state of FIG. 2, is then mounted on a top base 9 of the stamper 5, as shown in FIG. 3, then the peel-off paper on the lower surface of the double-side adhesive tape 8 is peeled off.

Figure 4:
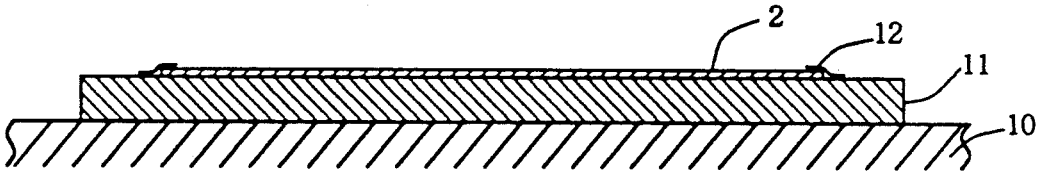
FIG. 4 is a sectional view in which a metal plate is disposed on a counterplate.

Meanwhile, as shown in FIG. 4, the metal plate 2 is set on a counterplate 11 disposed on a base 10 of the stamper 5 and is secured to the counterplate 11 by bonding its three sides thereto with adhesive tape 12.

Figure 5:
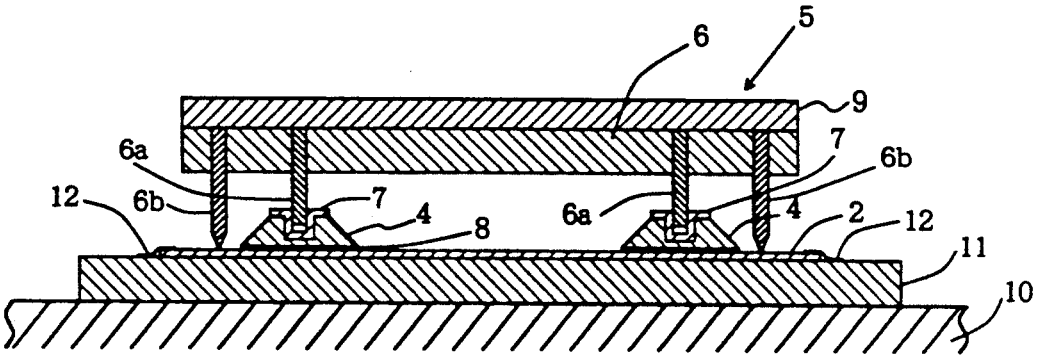
FIG. 5 is a sectional view showing a state in which the male die is lowered toward the metal plate.
Figure 6:
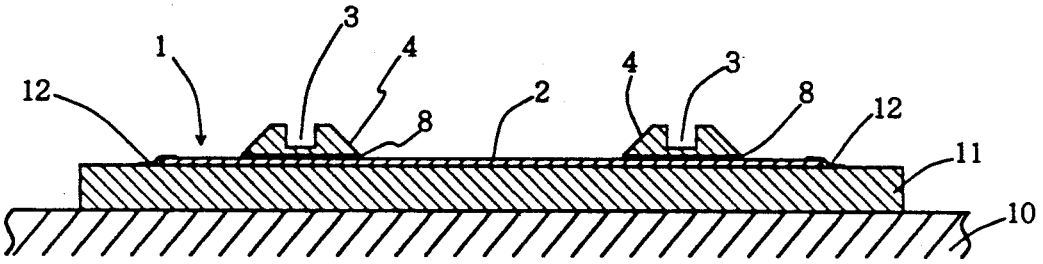
FIG. 6 is a sectional view showing the female die on the counterplate.

Then, as shown in FIG. 5, the male die 6 with the female die member 4 mounted thereon is lowered toward the metal plate 2 and secured to the same via double-side adhesive tape 8 provided on the bottom of female die 4, thus completing the female die 1 as shown in FIG. 6.

Figure 7:
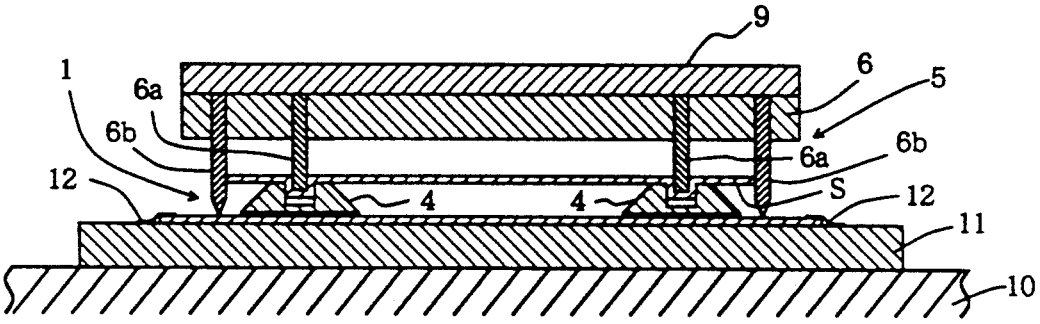
FIG. 7 is a sectional view showing paperboard stamping.

Afterwards, as shown in FIG. 7, stamping work S is supplied to the top of the female die member 4 and is stamped by lowering the male die 6 toward it. If the flatness of the top of the counterplate 11 is unsatisfactory or if defective stamping of the stamping work S is liable due to defective installation of the stamper, leveling is effected before subsequent stamping operation.

After the stamping operation is over, the metal plate 2 with the female die member 4 is removed from counterplate 11 by peeling of adhesive tape 12, and it is stored in a vertical state on a suitable storage rack (not shown). Since metal plate 2 is as thin as about 0.45 mm, several tens of metal plates can be stored on a single storage rack, which is desired in view of space savings.

Now, the case of using the female die 1 for re-stamping will be described with reference to FIGS. 8 and 13.

Figure 8:
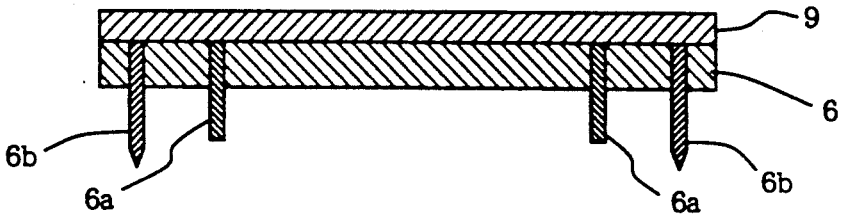
FIG. 8 is a sectional view showing a state in which the male die is mounted on a top base.
Figure 9:
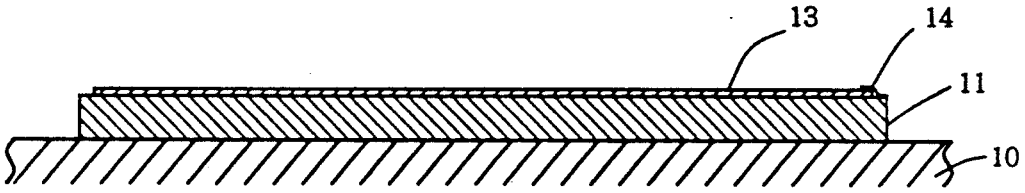
FIG. 9 is a sectional view showing a state in which a positioning sheet is disposed on the counterplate.
Figure 10:
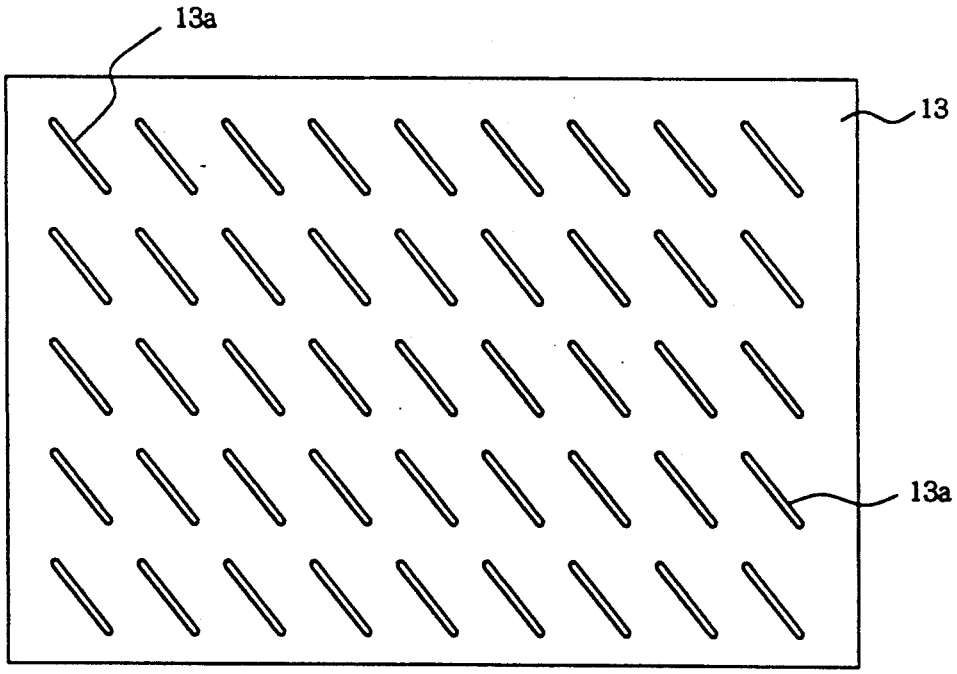
FIG. 10 is a plan view showing a positioning sheet.
Figure 11:
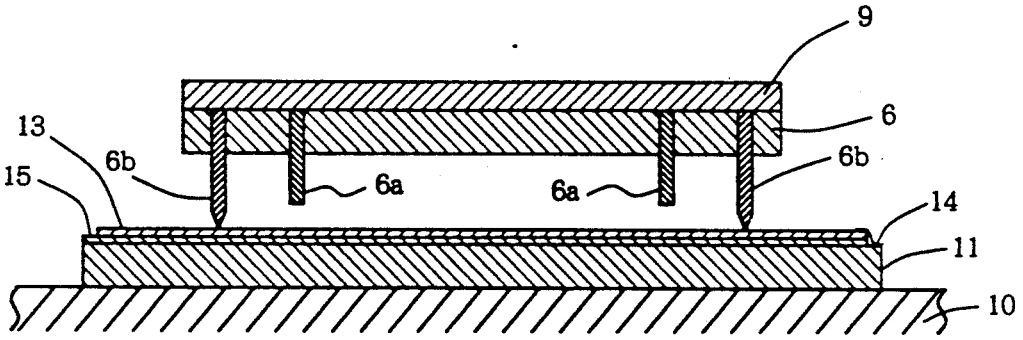
FIG. 11 is a sectional view showing a state in which the positioning sheet is given blade traces.

First, as shown in FIG. 8, the male die 6 is mounted on the top base 9 as in the case shown in FIG. 3. Then, as shown in FIG. 9, a positioning sheet 13 is set on the counter-plate 11, and one side of it is secured with adhesive tape 14. Positioning sheet 13, as shown in FIG. 10, has a plurality of elongated holes 13*a* for a see-through purpose. Then, as shown in FIG. 11, paperboard 15 with a thickness of 0.45 mm is provided between counterplate 11 and positioning sheet 13, and male die 6 is lowered with respect to positioning sheet 13 to provide the sheet with a trace of cutting blade 6*b* by bringing the latter into light contact with the latter.

Figure 12:
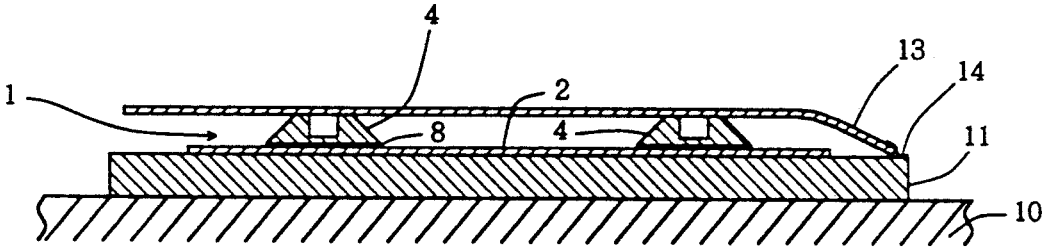
FIG. 12 is a sectional view showing a state, in which the female die is interposed between the counterplate and positioning sheet.

Then, as shown in FIG. 12, the paperboard 15 is removed, and the metal plate 2 with the female die member 4 is inserted between counterplate 11 and positioning sheet 13. The blade traces crossing the elongate holes 13*a* of the positioning sheet 13 (see FIG. 10) and the blade traces in the metal plate 2 are matched by seeing these blade traces through elongate holes 13*a* of positioning sheet 13. In this way, reliable and accurate positioning of metal plate 2 with respect to male die 6 can be obtained.

Figure 13:
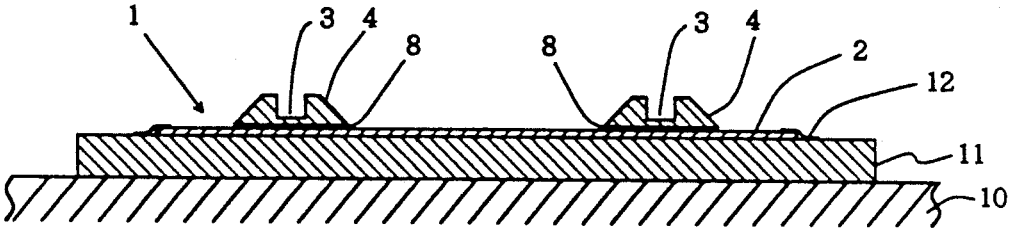
FIG. 13 is a sectional view showing the female die positioned on the counterplate.

Subsequently, as shown in FIG. 13, the positioning sheet 13 is removed, and the metal plate 2 is secured to the counterplate 11 with adhesive tape 12.

Afterwards, accurate stamping of stamping work S can be obtained in the same way as shown in FIG. 7.

As has been shown, in the female die 1 according to the invention the female die member 4 with the groove 3 corresponding in shape to the shape of the blade 6*a* of the male die 6 is provided on one surface of the thin metal plate 2, and the metal plate 2 is capable of being mounted and dismounted with respect to the counterplate 11. Thus, the operation of mounting the female die 1 on the counterplate 11 can be effected within 10 minutes. Thus, a single prearrangement is possible. This means that it is possible to reduce the prearrangement time and greatly improve the capacity of processing stamping work S.

Further, since the female die member 4 is mounted and dismounted with respect to the counterplate 11 in a state mounted on the metal plate 2, the female die member 4 need not be discarded when it is used once but can be used until its mechanical life is exhausted, which is economically desirable.

Further, since the metal plate 2 is as thin as about 0.45 mm, a large number of metal plates can be stored in a vertical state on a suitable rack or the like. This means a great reduction of storage space compared to the prior art, where a large number of counterplates 11 have to be stored.

The above embodiment of the invention is by no means limitative, and various changes and modifications are possible without departing from the scope of the invention. For example, as the shape of the female die member 4, various shapes may be adopted in correspondence to the shapes of paperboard products to be obtained by stamping. Further, the female die 1 according to the invention may be used for various different paperboard stampers, from a victoria stamper to an auto-platen.

As has been described in the foregoing, according to the invention the metal plate is very thin and thus is very convenient for storage. In addition, since it is mounted and dismounted with respect to the counterplate when it is used, it can cope with with a large number of stamping operations irrespective of the shape of the male die. Thus it is possible to provide a female die for a paperboard stamper which is excellent in operability and economy, and is very useful.

What is claimed is:

1. A female die for a paperboard stamper, comprising:
a counterplate;
a female die member having a groove therein; and
a female die comprising a thin metal plate having said female die member mounted thereon, said female die being removably mounted on said counterplate with adhesive tape.

2. The female die of claim 1, wherein said female die member is mounted to said thin metal plate by double sided adhesive tape.

3. The female die of claim 1, wherein said female die member has a flat bottom surface disposed against the upper surface of said thin metal plate and said groove is formed in the upper surface of said female die member.

4. The female did of claim 1, wherein said groove of said female die member forms a quadrangle and said thin metal plate is a rectangular steel plate.

5. The female die of claim 1, wherein said female die member is adhered to said thin metal plate.

6. A paperboard stamping system, comprising:
a male die having a rule blade of a predetermined shape and a cutter blade adjacent to said rule blade; and
a female die comprising a counterplate, a female die member having a groove therein, and a thin metal plate having said female die member mounted thereon, said and thin metal plate being removably mounted on said counterplate with adhesive tape.

7. The paperboard stamping system to claim 6, wherein said female die member is mounted to said thin metal plate by double sided adhesive tape.

8. The paperboard stamping system of claim 6, wherein said female die member has a flat bottom surface disposed against an upper surface of said thin metal plate and said groove is formed in an upper surface of said female die member.

9. The paperboard stamping system of claim 6, wherein said groove of said female die member forms a quadrangle and said thin metal plate is a rectangular steel plate.

10. The paperboard stamping system of claim 6, wherein said female die member is adhered to said thin metal plate.

11. The paperboard stamping system of claim 6, wherein said groove of said female die member corresponds to the shape of said rule blade.

12. The paperboard stamping system of claim 6, and further comprising a positioning means for positioning said thin metal plate with said female die member thereon on said counterplate.

13. The paperboard stamping system of claim 12, wherein said positioning means comprises a positioning sheet having a plurality of elongated holes therein.

14. The paperboard stamping system of claim 6, and further comprising a positioning sheet for positioning said thin metal plate with said female die member thereon on said counterplate.

* * * * *